US006267117B1

(12) United States Patent
Bisson

(10) Patent No.: US 6,267,117 B1
(45) Date of Patent: Jul. 31, 2001

(54) HAIR CUTTING METHOD AND DEVICE

(76) Inventor: Frank Peter Bisson, 12 Rochdale House, 17 Slate Wharf, Castlefield, Manchester M15 4SX (GB)

( * ) Notice: Subject to any disclaimer, the term of this patent is extended or adjusted under 35 U.S.C. 154(b) by 0 days.

(21) Appl. No.: 09/445,921

(22) PCT Filed: Jun. 19, 1998

(86) PCT No.: PCT/GB98/01633

§ 371 Date: Dec. 14, 1999

§ 102(e) Date: Dec. 14, 1999

(87) PCT Pub. No.: WO98/58778

PCT Pub. Date: Dec. 30, 1998

(30) Foreign Application Priority Data

Jun. 20, 1997 (GB) ..... 9712929

(51) Int. Cl.[7] ..... A45D 24/00

(52) U.S. Cl. ..... 132/200; 132/212; 132/213; 132/213.1; 30/30; 30/295

(58) Field of Search ..... 132/212, 213, 132/213.1, 214, 215, 200; 30/226, 227, 229, 254, 260, 30; D8/5, 57

(56) References Cited

U.S. PATENT DOCUMENTS

| | | | | |
|---|---|---|---|---|
| 2,180,834 | | 11/1939 | Marcel . | |
| 2,562,421 | * | 7/1951 | Hendra | 132/213 |
| 3,996,663 | * | 12/1976 | Spanel | 30/30 |
| 4,391,040 | * | 7/1983 | Kanazawa | 30/201 |
| 4,928,716 | * | 5/1990 | Greene | 132/212 |

FOREIGN PATENT DOCUMENTS 2673878 9/1992 (FR) .

* cited by examiner

*Primary Examiner*—Pedro Philogene
(74) *Attorney, Agent, or Firm*—Michael Best & Frederich, LLP

(57) ABSTRACT

The invention concerns both a method and device for cutting hair. The device includes a multi-faceted cutting means (10) and a handle (20). The cutting means (10) is preferably formed from a broken piece of glass, preferably having a ragged broken edge to form a multi-faceted cutter with a plurality of cutting edges (13) distributed across it. Having cutting edges (13) distributed in this way, has been found to advantageously provide hair styling effects which give good texture to a hair cut and provide natural build.

31 Claims, 3 Drawing Sheets

HAIR CUTTING METHOD AND DEVICE

The invention relates to a hair cutting device and method.

Normal methods of cutting hair, such as with scissors or razor are well known. Such methods employ a single cutting edge which gives a straight cut. However, it can be difficult with such straight edges to impart texture and softness to the hair style.

According to a first aspect of the invention, there is provided a device for cutting hair, the device comprising a handle and a multi-faceted cutting means associated with the handle, said multi-faceted cutting means having a plurality of cutting edges.

Preferably, said cutting edges are disposed at different angles to one another along a length of a cutting surface.

The cutting edges may be disposed at different angles to one another across a width of said cutting surface.

The cutting edges are preferably irregularly distributed across a length and width of the cutting surface.

Preferably, said multi-faceted cutting means comprises glass having at least an exposed end portion which is rough and unfinished. The rough unfinished end portion is preferably achieved by breaking a piece of glass.

The advantage of using broken glass in the device is that a cutting end of the device is conveniently provided with a large number of cutting edges disposed irregularly and randomly at different angles to one another both across a length and width of the cutting means.

Using said cutting device instantly results in a textured cut in which the ends of the hair resulting from a single pass of the cutting device are cut to different lengths to provide a more natural cut.

The handle may comprise first and second pieces of material attached to one another with a non-cutting end of the cutting means sandwiched between them. The cutting means may be glued or bonded to the handle.

The handle may comprise any suitable material such as wood, or plastics material.

The handle is preferably provided with indentations for enabling it to be better gripped by the hand of a hair stylist.

A groove may be provided running across the handle.

Preferably, different embodiments of the device are provided for achieving different effects. For instance, a first embodiment may comprise a fine tool which may be held by the stylist in his hand in the manner in which a pen or scalpel would be held. Such a device may be used for making fine changes to a hair style. In another embodiment, a larger device may be provided having a handle, a first side of which is adapted to receive the fingers of stylist and the other side of which receives the stylist's thumb so that the handle is griped between the fingers on one side and the thumb on the other in, for instance, the manner of a comb or a brush.

The handle may be provided with a slot for receiving the cutting means therein.

The handle may incorporate means for preventing the fingers of a device operator from inadvertently slipping from the handle and onto the cutting means. Such means may comprise a protruding lip or ledge formed around a lower region of the handle adjacent to an upper part of the cutting means.

Different lengths and/or widths of cutting means may also be provided for achieving different styling effects.

According to a second aspect of the invention, there is provided a method of cutting hair, the method comprising using a device for cutting hair including a handle with an attached multi-faceted cutting means having a plurality of cutting edges to cut hair at a variety of angles and lengths.

Preferably, said cutting edges are disposed at different angles to one another along a length of a cutting surface.

The cutting edges may be disposed at different angles to one another across a width of a cutting surface.

The cutting edges are preferably irregularly distributed across a length and width of a cutting surface.

The method may comprise lifting hair away from the head with a comb and dragging the cutting means across the hair so as to cut it.

Preferably, the cutting means comprises a piece of glass having a ragged broken edge, said ragged broken edge forming the cutting edges of the cutting means.

The method may comprise making fine adjustments to hair, length and style by using the device held in the manner in which a pen or scalpel is generally held and sculpting the hair.

The method may include scrunch styling in which hair is pulled up and scrunched together prior to cutting with the device. When using the cutting means for scrunch styling, it has been found that the ragged ends imparted by the cutting means to the hair enables the hair to hold better its position due to increased texture throughout the hair cut.

The method may be used selectively in combination with any other forms of hair styling to enable texture to be imparted to the hair cut.

For a better understanding of the invention, and to show how embodiments of the same may be carried into effect, reference will now be made, by way of example, to the accompanying diagrammatic drawings, in which.

Figure 1:
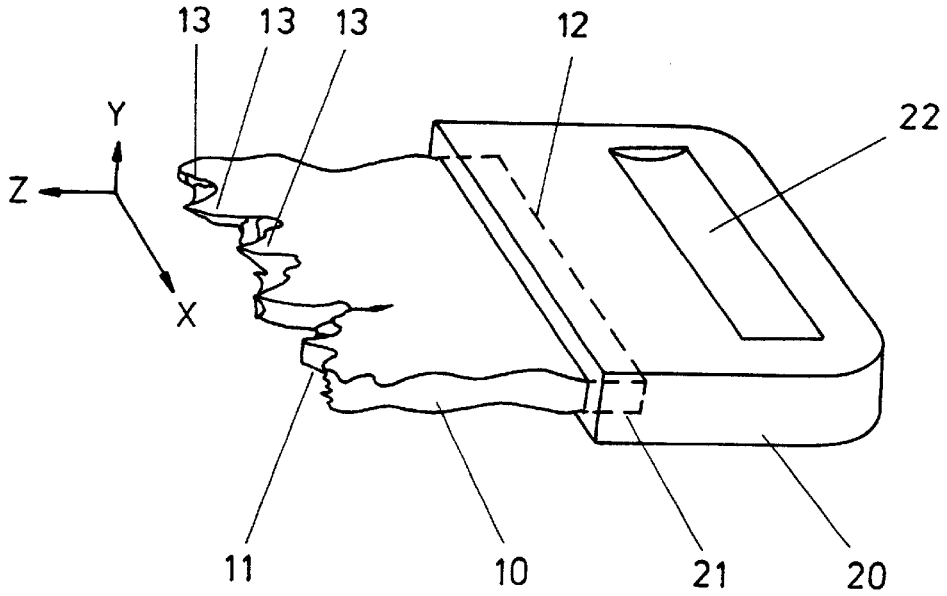
FIG. 1 shows a first embodiment of hair cutting device in perspective view.
Figure 2:
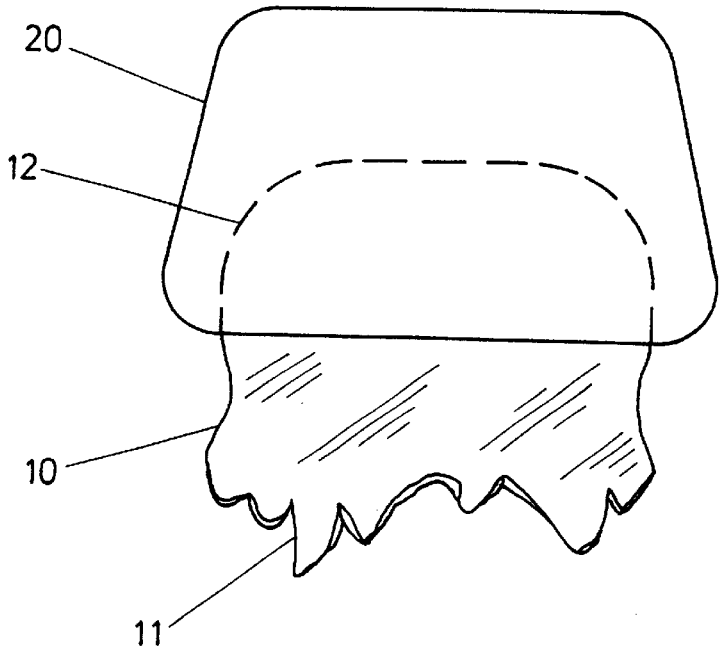
FIGS. 2 to 6 show various different handle styles which may be used with the device of the type shown in FIG. 1.

Referring initially to FIG. 1, there is shown a cutting means 10 and handle 20. The cutting means 10 comprises a piece of glass having a ragged broken edge 11 and an edge 12 (shown dotted) remote from said cutting edge 11 and received and held by a slot 21 of the handle 20. The edge 12 may be glued or bonded in some way into the slot 21.

The broken edge 11 forms a multi-faceted cutter with a plurality of cutting edges 13 (only some of which are labelled 13) distributed across it length-wise (in the X-direction), width-wise (Y-direction) and depth-wise (Z-direction), so that they are not only distributed across the edge 11 but also protrude in a generally random fashion with respect to one another by varying amounts.

Handle 20 further comprises a groove 22 to receive fingers or thumb and help the device be gripped better. Although not shown, it will be appreciated that there is a corresponding groove formed on the opposing side of the handle 20.

Figure 3:
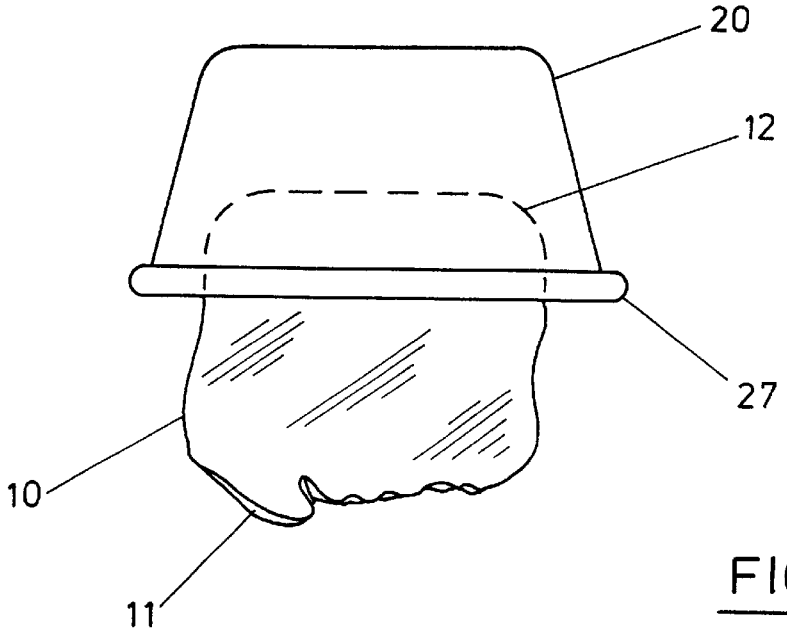
Figure 4:
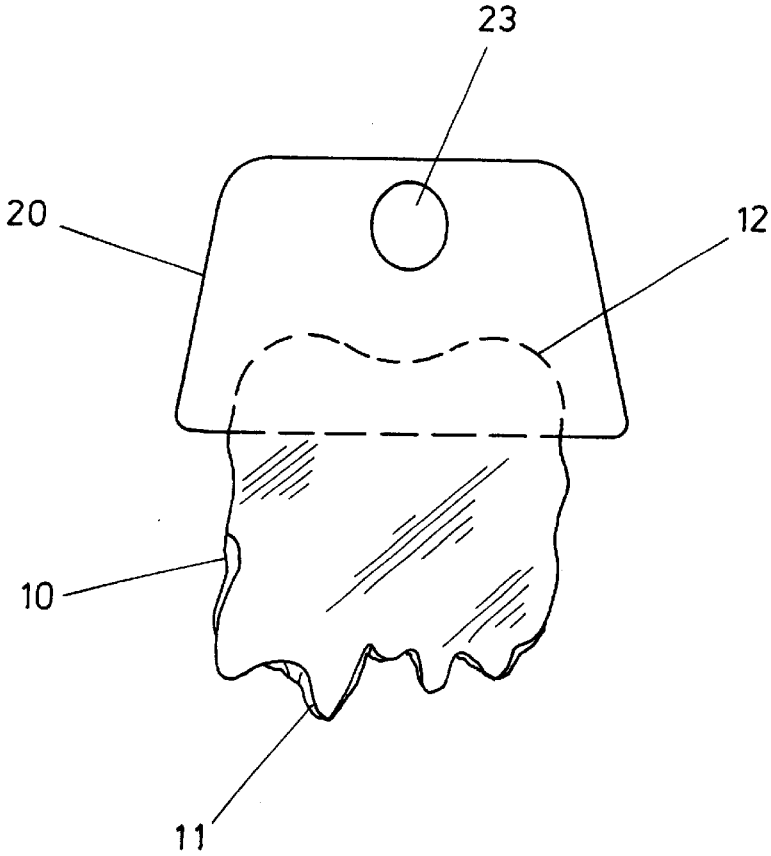

Referring now to FIGS. 2 to 6, there are shown various modifications to the embodiment of FIG. 1. Features of the embodiments of FIGS. 2 to 6 which correspond to the same features as those shown in FIG. 1 are not discussed. In the embodiment of FIG. 3, there is shown a protruding lip or ledge 27 formed circumferentially around the base of the handle 20. The purpose of this ledge 27 is to prevent the finger tips of the stylist from slipping off the handle 20 and onto the glass of the cutting means 10. In the embodiment of FIG. 4, one difference is that instead of a groove 22 formed on one side of the handle 20 there is provided an indentation 23 for receiving a thumb of the stylist. Similarly, in FIG. 4, the variation shows the handle 20 having a number of indentations 24, 25, 26 for receiving fingers or thumb of the stylist. It will be understood that similar indentations may be provided on the opposing side of the handle 2 which is not shown in FIG. 5.

Figure 5:
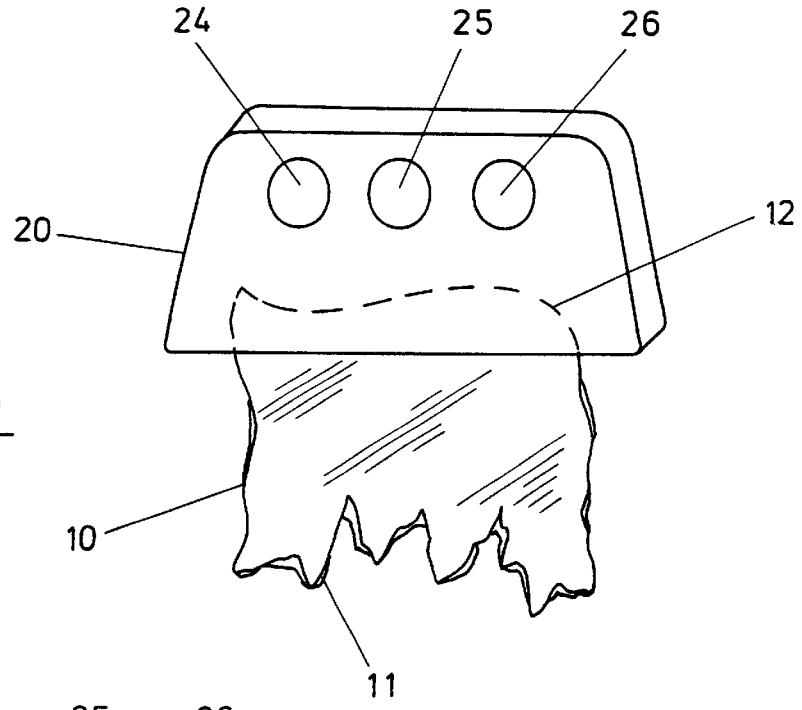
Figure 6:
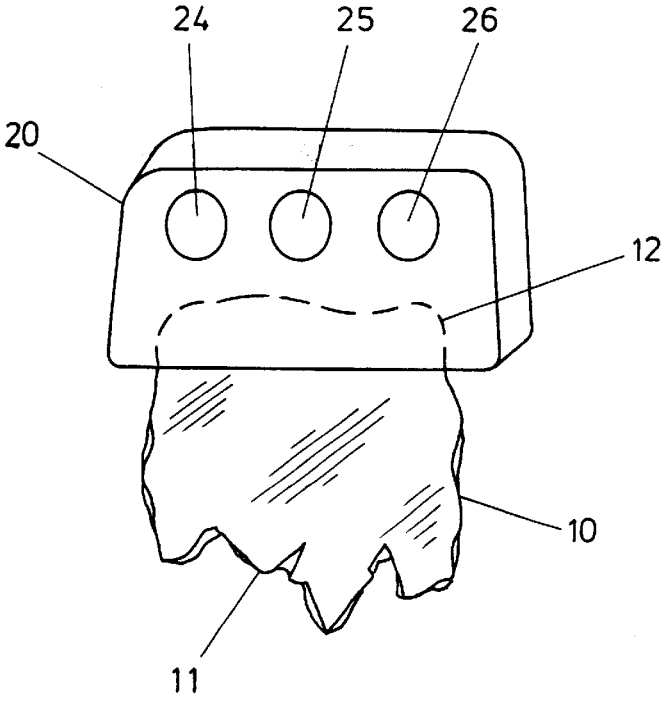

The embodiment of FIG. 6 is broadly similar to that of FIG. 5, but has a slightly different shaped handle.

Figure 7:
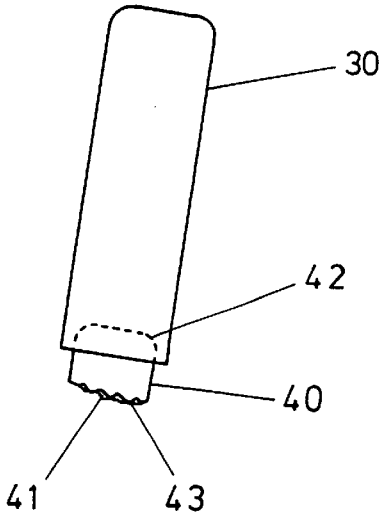
FIG. 7 shows another embodiment of the device.

Referring now to FIG. 7, there is shown a different style of the device comprising a relatively long and slim handle portion 30 and a relatively short piece of broken glass 40. The piece of glass 40 has a ragged broken edge 41 (similar in respects to edge 11 of the other embodiments) and an edge 42 remote from the edge 41, the edge 42 and the area of the glass 40 adjacent to the edge 42 are fixedly attached to the handle 30. The handle 30 is shaped so that the device of FIG. 7 may be used in a similar fashion to a scalpel. In contrast, the device of the embodiments of FIGS. 1 to 6 is gripped in a similar way to a comb or a brush may be gripped. It will be understood that the tool of FIG. 7 therefore may be especially suited to fine work and the device of FIGS. 1 to 6 may be used for coarser working.

Now that various embodiments of the device have been described, general use of this device and its advantages over conventional methods will be discussed.

As mentioned, the device of the embodiments of FIGS. 1 to 6 may be gripped like a comb or a brush when used.

It can be used in conjunction with conventional styling techniques. For instance, a comb may be used in one hand, whilst the device may be used in the other hand, the comb being used to raise lengths of the hair and the device being used to cut it. The device may also be used in so called scrunch styling.

Although it sounds rather odd to cut hair using broken glass, it will be appreciated that this may be carried out in a perfectly safe manner and is simply one extra tool for the hair stylist to be able to use. The device of FIG. 7 may be used for making fine changes, in the way that a razor might for instance be used.

Advantages to using the device are that the multi-faceted nature of the cutting edge gives a greater number of cutting angles in the hair cut and more softness and texture throughout. When used for scrunch styling, hair will hold better due to the increased texture throughout the hair cut. Also, the tool has been found to be excellent for producing spiky hair styles or very textured cuts, each piece of glass along the edge of the tool giving a different texture to the hair. Every hair style developed using the device is unique and a combination of different pieces of glass could be used in a single hair cut to create multi-textured cuts.

"Glass cutting" has been found by the inventor to be an excellent method for people who do not want to use products on their hair such as mousses or lacquers to build up the hair. The texture and cutting angles imparted by the tool tend to give build to the hair on their own. In a similar fashion, people who may have medical conditions such as scalp conditions and cannot use styling products will find the glass cutting method to be of benefit.

Because of the nature of the cut, if someone has a thick head of hair then glass cutting is a natural way of thinning out the hair without providing an artificial look. Also, hair can be cut from above or below due to the multiple and versatile cutting angles of the glass.

In summary, the benefit of the invention has been found to lie in the fact that instead of having a single cutting edge a plurality of cutting edges are combined in a single tool. In particular, the large number of cutting edges distributed across the length of the cutting end of the device (and to a more modest extent across the width) give a particularly effective cut which adds texture.

Whilst the embodiments described utilise broken pieces of glass to form the cutting means, it could be envisaged that other materials might be utilised. However, glass has been found particularly effective as it is easy to break, can be used in different sizes and, by the nature in which it breaks is particular good as it naturally forms the irregular collection of cutting edges.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A device for cutting hair, the device comprising a handle (20, 30) and a multi-faceted cutting means (10, 40) associated with the handle (20, 30), said multi-faceted cutting means (10, 40) having a plurality of cutting edges (13, 43) and being characterized in that the cutting means is formed of glass.

2. A device according to claim 1, wherein said cutting edges (13, 43) are disposed at different angles to one another along a length of a cutting surface (11, 41).

3. A device according to claim 1, wherein the cutting edges (13, 43) are disposed at different angles to one another across a width of a cutting surface (11, 41).

4. A device according to claim 1, wherein said cutting edges (13, 43) are arranged to protrude from a cutting surface (11, 41) to different extents to one another across the length of the cutting surface (11, 41).

5. A device according to claim 1, wherein the cutting edges (13, 43) are irregularly distributed across a length and width of cutting surface (11, 41).

6. A device according to any of the preceding claim 1, wherein the cutting edges (13, 43) are irregularly distributed across a length, width and depth of a cutting surface (11, 41).

7. A device according to claim 1, wherein said multi-faceted cutting means (10, 40) has at least an exposed end portion which is rough and unfinished.

8. A device according to claim 7, wherein the rough unfinished end portion is achieved by breaking a piece of glass.

9. A device according to claim 1, wherein said handle (20, 30) comprises first and second pieces of material attached to one another with a non-cutting end (12, 42) of the cutting means (10, 40) sandwiched between them.

10. A device according to claim 1, wherein the cutting means (10, 40) is glued or otherwise bonded to the handle (20, 30).

11. A device according to claim 1, wherein the handle (20, 30) comprises a piece of material having a slot (21, 31) formed therein for receiving a non-cutting end (12, 42) of the cutting means (10, 40).

12. A device according claim 1, wherein the handle (20, 30) is provided with one or more indentations (22, 23, 24, 25, 26) for enabling it to be better gripped by a hand of a hair stylist.

13. A device according to claim 12, wherein a groove (22) is provided running across the handle.

14. A device according to claim 1, wherein the handle (30) is an elongate handle, to one end of which, the cutting means (40) is attached.

15. A device according to claim 1, wherein the device comprises an elongate handle (20), the cutting means (10) being provided along the length of the handle (20).

16. A device according to claim 1, wherein a first side of the handle (20) is adapted to receive the fingers of a stylist and an opposing side of the handle is adapted to receive a thumb of the stylist, so that the handle (20) may be gripped between the fingers and thumb of one hand, in, for instance, the manner of a comb or a brush.

17. A device according to claim 1, wherein the handle includes means for preventing the fingers of an operator of the device from inadvertently slipping form the handle (20, 30) onto the cutting means (10, 30).

18. A device according to claim 17, wherein said means for preventing inadvertent finger slipping comprise a protruding lip (27) formed around a lower region of the handle (20, 30) and adjacent to an upper exposed portion of the cutting means (10, 40).

19. A device according to claim 1, wherein varying dimensions to the cutting means, such as reducing or increasing length or width of the cutting means (10, 40) provides different styling effects.

20. A method of cutting hair, the method comprising using a multi-faceted, glass cutting means (10, 40) having a plurality of cutting edges (13, 43) to cut hair at a variety of angles and lengths.

21. A method according to claim 20, wherein said cutting edges (13, 43) are disposed at different angles to one another along a length of a cutting surface (11, 41).

22. A method according to claim 20, wherein the cutting edges (13, 43) are disposed at different angles to one another across a width of a cutting surface.

23. A method according to claim 20, wherein said cutting edges (13, 43) are arranged to protrude from a cutting surface (11, 41) to different extents to one another across the length of the cutting surface (11, 41).

24. A method according to claims 20, wherein the cutting edges (13, 43) are irregularly distributed across a length and width of a cutting surface (11, 41).

25. A method according to claims 20, wherein the cutting edges (13, 43) are irregularly distributed across a length, width and depth of a cutting surface (11, 41).

26. A method according to claim 20, wherein said multi-faceted cutting means (10, 40) has at least an exposed end portion (11, 41) which is rough and unfinished.

27. A method according to claim 20, the method comprising lifting hair away from a head of a client with a comb and dragging the cutting means (10, 40) across the hair so as to cut it.

28. A method according to claims 20, wherein the cutting means (10, 40) comprises a piece of glass having a ragged broken edge (11, 41) forming the cutting edges (13, 43) of the cutting means.

29. A method according to any of claim 20, the method comprising making fine adjustments to a client's hair by using the cutting means (10, 40) held in the manner in which a pen or scalpel is generally held and sculpting the hair.

30. A method according to claim 20, wherein the method includes scrunch styling in which hair is pulled up and scrunched together prior to cutting using the multi-faceted cutting means (10, 40).

31. A method according to claims 20, wherein the method is used in combination with other forms of hair styling to enable texture to be imparted to the style of the cut hair.

* * * * *